US008342894B2

(12) United States Patent
Uchiyama et al.

(10) Patent No.: US 8,342,894 B2
(45) Date of Patent: Jan. 1, 2013

(54) TERMINAL FITTING

(75) Inventors: Yoshihiro Uchiyama, Yokkaichi (JP); Shinji Iihoshi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/059,073

(22) PCT Filed: Jun. 25, 2009

(86) PCT No.: PCT/JP2009/061626

§ 371 (c)(1),
(2), (4) Date: Feb. 15, 2011

(87) PCT Pub. No.: WO2010/024033

PCT Pub. Date: Mar. 4, 2010

(65) Prior Publication Data

US 2011/0177728 A1 Jul. 21, 2011

(30) Foreign Application Priority Data

Aug. 27, 2008 (JP) ..... 2008-218195
Nov. 28, 2008 (JP) ..... 2008-304479

(51) Int. Cl.
*H01R 4/10* (2006.01)

(52) U.S. Cl. ..... 439/882

(58) Field of Classification Search ..... 439/882, 439/877

See application file for complete search history.

(56) References Cited

U.S. PATENT DOCUMENTS 7,306,495 B2 * 12/2007 Hashimoto et al. ..... 439/877
7,955,147 B1 * 6/2011 Legrady et al. ..... 439/877

FOREIGN PATENT DOCUMENTS

| | | |
|---|---|---|
| JP | 54-156196 | 12/1979 |
| JP | 2005-222815 | 8/2005 |
| JP | 2008-262842 | 10/2008 |
| WO | 2007/043345 | 4/2007 |

* cited by examiner

*Primary Examiner* — Phuong Dinh
(74) *Attorney, Agent, or Firm* — Gerald E. Hespos; Michael J. Porco

(57) ABSTRACT

A terminal fitting includes an open-barrel shaped electric wire crimping section for connecting a conductor of an electric wire to the terminal fitting by crimping. The electric wire crimping section has a clamping region in a range except for both ends of the electric wire crimping section in a wiring direction of the conductor. A fixing portion is formed by displacing a part of the clamping region of the electric wire crimping section to the conductor. Locking portions are disposed at both sides of the fixing portion in the wiring direction of the conductor with the fixing portion being located between them respectively. The locking portions are configured for coupling the fixing portion and a remainder of the electric wire crimping section to each other in a step-like way.

14 Claims, 9 Drawing Sheets

TERMINAL FITTING

BACKGROUND OF THE INVENTION

1. Field of the Invention

The present invention relates to a terminal fitting.

2. Description of the Related Art

In Japanese Patent Application Laid-Open No. 2005-222815, a terminal fitting having an electric wire crimping section for connecting an electric wire to the terminal fitting by crimping is disclosed. In this terminal fitting, the construction in which the groove is formed on the contact surface of the electric wire crimping section which contacts the conductor of the electric wire is adopted. In this construction, the periphery of the conductor is caught by the groove. Thereby the conductor-fixing force of the electric wire crimping section is enhanced.

In Japanese Patent Application Laid-Open No. 2008-262842, there is disclosed a terminal fitting having the electric wire crimping section constructed of the substrate part where an electric wire is placed and a pair of barrel pieces projected from both sides of the substrate part and crimped from the outside to the core exposed to the outside at the end of the electric wire. In this construction, by crimping both barrel pieces to the core, the terminal fitting is electrically connected to the electric wire.

In the terminal fitting described in Japanese Patent Application Laid-Open No. 2005-222815, the depth of the groove is limited to the range of the sheet thickness of the electric wire crimping section. Thus the groove has a small locking area in locking the conductor thereto. Therefore when the electric wire crimping section is thin, there is a case in which a sufficient conductor-fixing force cannot be obtained.

In the terminal fitting described in Japanese Patent Application Laid-Open No. 2008-262842, by forming the concave portion which decreases the sheet thickness of the barrel pieces on the inner surfaces thereof and disposing the core along the inner surface of the concave portion, it is possible to enhance the core-retaining force of both barrel pieces and improve the reliability in the connection between the terminal fitting and the electric wire. But in this case, when the crimping force of both barrel pieces is set high, the barrel pieces spread with a crimping operation. Therefore there is a great reduction in the sheet thickness of portions of the barrel pieces disposed at a position corresponding to the position of the concave portion. Thereby there occurs a problem that the strength of the electric wire crimping section becomes short.

The present invention has been completed based on the above-described situation. It is an object of the present invention to improve the conductor-fixing force of an electric wire crimping section. It is another object of the present invention to secure the strength of the electric wire crimping section.

SUMMARY OF THE INVENTION

To achieve the above-described or other objects, the invention provides a terminal fitting comprising an open-barrel shaped electric wire crimping section for connecting a conductor of an electric wire to the terminal fitting by crimping, the electric wire crimping section having a clamping region in a range except for both ends of the electric wire crimping section in a wiring direction of the conductor; a fixing portion formed by displacing a part of the clamping region of the electric wire crimping section to the conductor; and a plurality of locking portions disposed at both sides of the fixing portion in the wiring direction of the conductor with the fixing portion being located therebetween respectively and having a form of coupling the fixing portion and a remainder of the electric wire crimping section to each other in a step-like way.

According to the above-described construction, in a state in which the conductor is crimped to the electric wire crimping section, the conductor is caught by the locking portion. Thereby the electric wire crimping section has an improved conductor-fixing force. In addition, because the thickness of the electric wire crimping section is not decreased, the strength thereof can be securely obtained.

Each locking portion has a thickness in a direction in which the electric wire crimping section is displaced to the conductor, and the thickness may be set larger than that of the fixing portion. According to the above-described construction, even though a large clamping force is set in crimping the wire barrel part to the conductor, the thick locking portion little deforms. Thus there is no decrease in the locking area of the locking portion in locking the conductor thereto.

The fixing portion may have an end surface disposed nearly along the wiring direction of the conductor. Thereby the conductor is disposed along the end surface of the fixing portion.

A cut-into portion projected to the conductor like a rib may be formed on the end surface of the fixing portion. Thereby the fixing portion locks the conductor thereto owing to the operation of the cut-into portion which cuts into the periphery of the conductor. Thus the fixing portion has a high fixing force.

The electric wire crimping section may have a substrate part on which the conductor is plated; and a pair of barrel pieces, projected from both sides of the substrate part, which are crimped to the conductor from an outside. The fixing portion is formed on the barrel pieces. A concave portion concave to an inner surface of each of the barrel pieces is formed at a portion, of an outer surface of each of the barrel pieces thereof, which corresponds to the fixing portion; and a convex portion projected to the conductor is formed at a position, of an inner surface of each of the barrel pieces, which corresponds to the fixing portion with the convex portion and the concave portion being disposed back to back. Because the convex portion projected to the conductor is formed on the inner surface of each of the barrel pieces, it is possible to enhance the conductor-holding force of each barrel piece and improve the connection reliability between the terminal fitting and the electric wire. Further the concave portion is formed on the outer surface of each of the barrel pieces, and the convex portion is formed on the inner surface of each barrel piece with the convex portion and the concave portion being disposed back to back. Therefore compared with a case in which only the concave portion which decreases the sheet thickness of both barrel pieces is formed thereon, the strength of both barrel pieces is properly secured. This operation and effect are similar to those of the first embodiment of the invention described above.

The convex portion and the concave portion may be formed on only the barrel pieces. The convex portion and the concave portion are formed efficiently on the barrel pieces which apply a high crimping force to the conductor. Therefore it is possible to prevent the construction from becoming complicated more than necessary.

The convex portion and the concave portion may be formed in the shape of a striate extending in a direction intersecting with a direction in which the conductor is wired. This construction further enhances the core-retaining force of the barrel piece.

The present invention also provides a method of producing a method of producing a terminal fitting having a substrate part supporting an electric wire; and a pair of barrel pieces projected from both sides of the substrate part. A conductor exposed to an outside at an end of the electric wire is placed on the substrate part. Both barrel pieces are crimped to the conductor placed on the substrate part. Outer surfaces of the barrel pieces are stricken as soon as a crimping operation is performed or after the crimping operation finishes to form a concave portion concave toward an inner-surface of each of the barrel pieces on the outer surface of each barrel piece and a convex portion projected to the conductor at a position, of the inner surface of each of the barrel pieces, where the convex portion and the concave portion are disposed back to back. Because the convex portion and the concave portion are formed as soon as the caulking crimping operation is performed or after the crimping operation finishes, both barrel pieces crimped to the conductor is effectively prevented from undergoing deformation of opening outward owing to spring back.

According to the present invention, it is possible to improve the conductor-fixing force of the electric wire crimping section. It is also possible to secure the strength of the electric wire crimping section.

DETAILED DESCRIPTION OF THE PREFERRED EMBODIMENTS

Embodiment 1

Figure 1:
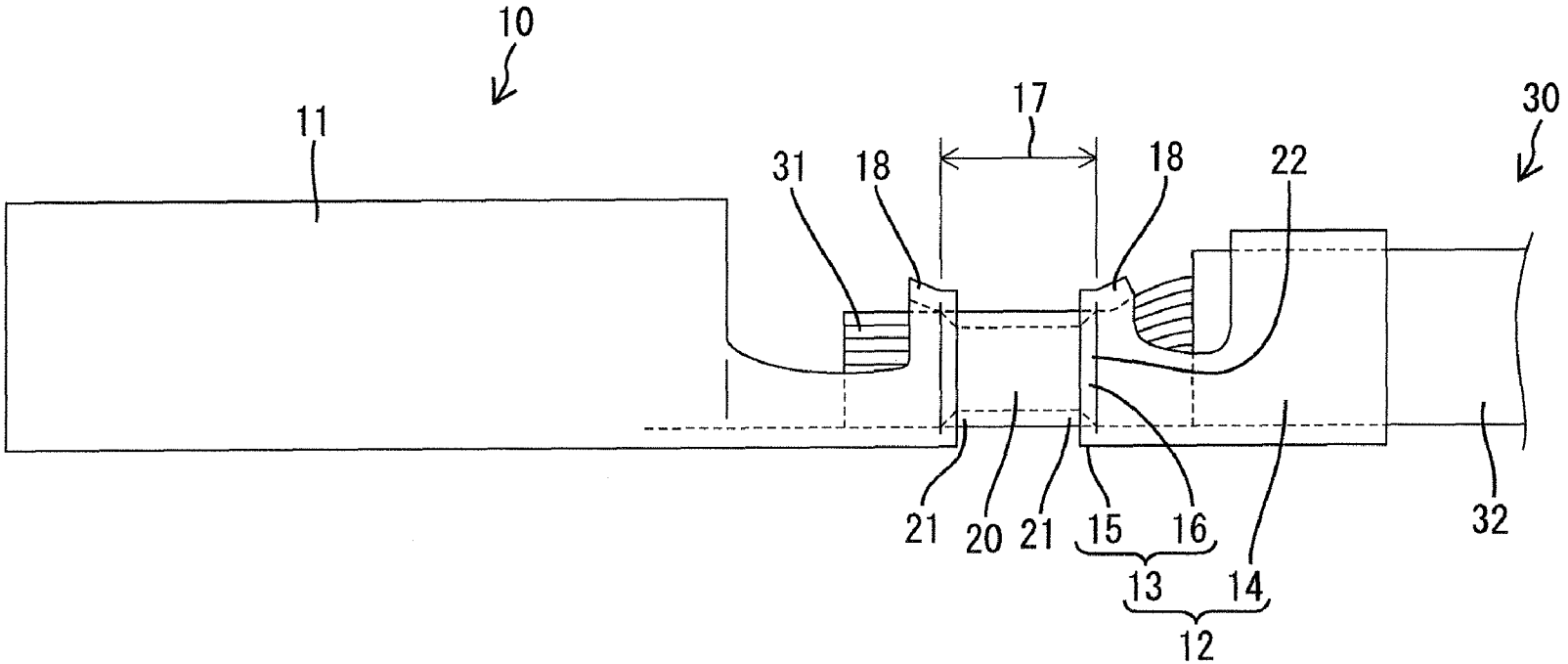
FIG. 1 is a side view showing a state in which an electric wire is crimped to a terminal fitting of an embodiment 1 of the present invention.
Figure 2:
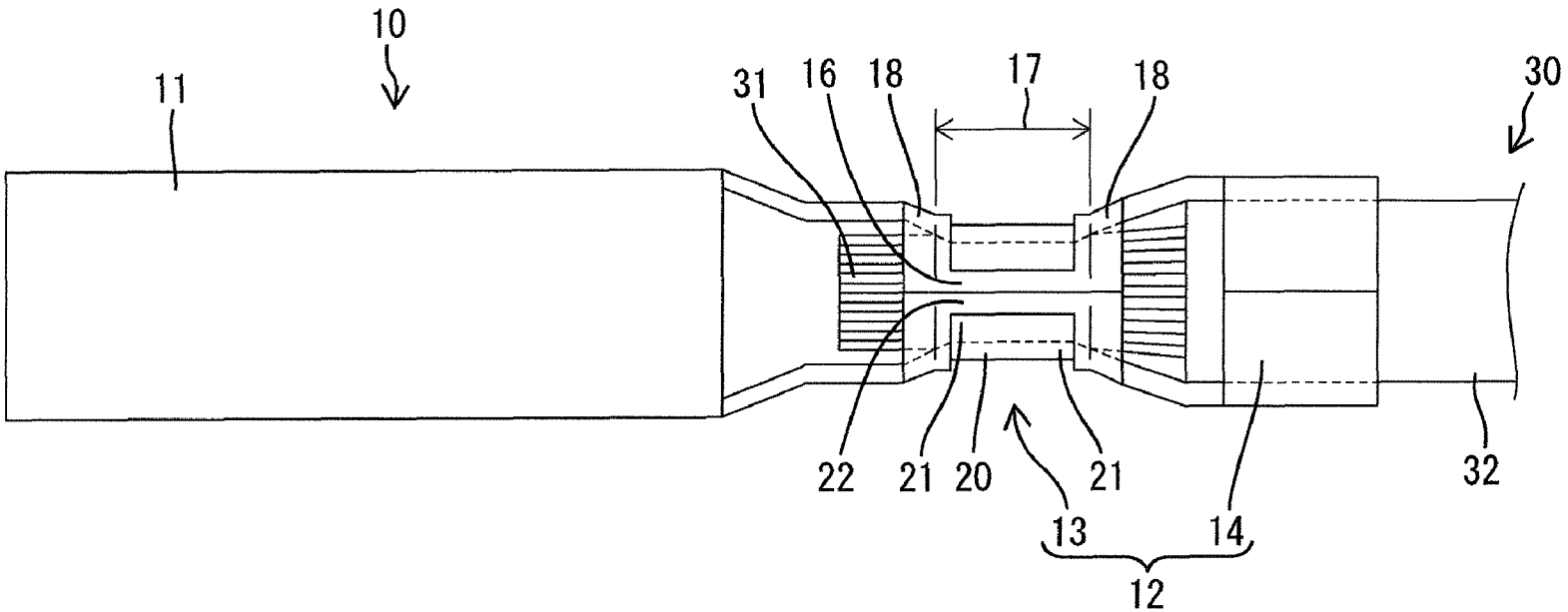
FIG. 2 is a plan view showing a state in which the electric wire is crimped to the terminal fitting.
Figure 3:
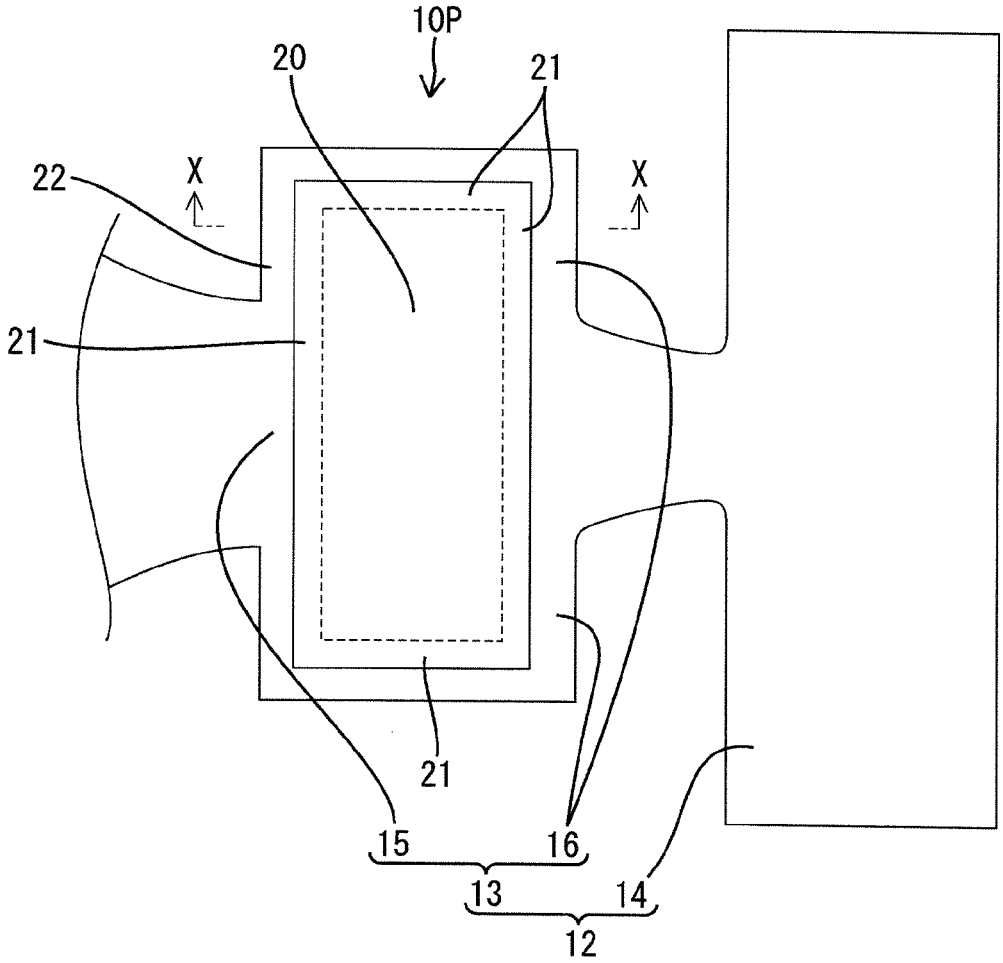
FIG. 3 is a plan view showing the configuration of an electric wire crimping section of a metal plate.
Figure 4:
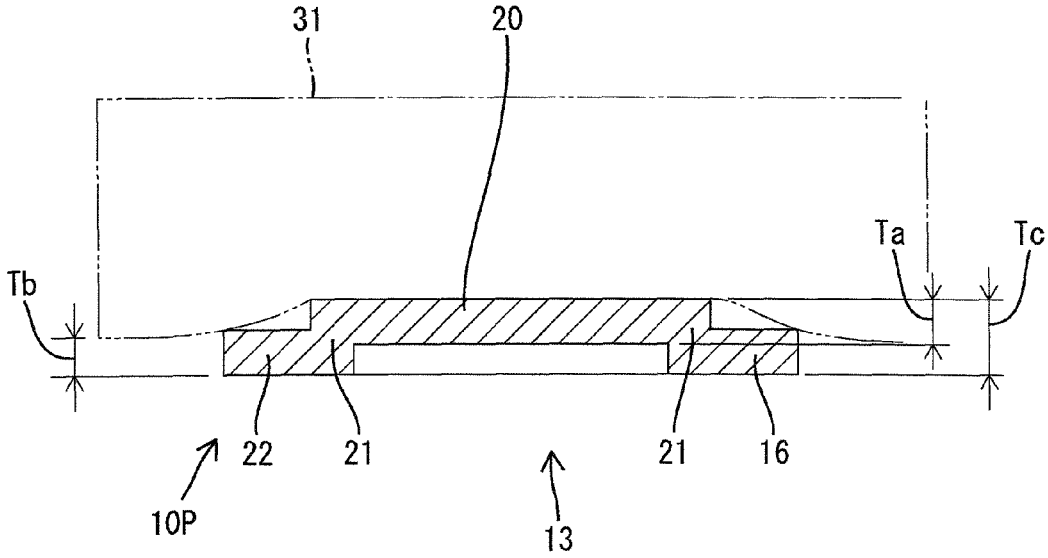
FIG. 4 is a sectional view taken along a line X-X of FIG. 3.

The embodiment 1 of the present invention is described below with reference to FIGS. 1 through 4. A terminal fitting 10 of the embodiment 1 is of a female type formed by bending a metal plate 10P punched in a predetermined configuration. A front part of the terminal fitting 10 is formed as a prism-shaped terminal fitting connection section 11. The terminal fitting connection section 11 has a known form functioning as a connection means to be connected to a long and narrow tab (not shown in the drawings) of a male mating terminal fitting.

A rear part of the terminal fitting 10 is formed as an open barrel-shaped electric wire crimping section 12. A front end of an electric wire 30 is connected to the electric wire crimping section 12 by crimping. The electric wire 30 is constructed of a conductor 31 serving as a core consisting of a twisted wire formed by twisting a plurality of thin metal wires together and an insulating coating 32 surrounding the conductor 31. At the front end of the electric wire 30, to connect the electric wire 30 to the terminal fitting 10, the insulating coating 32 is removed in advance to expose the front end of the conductor 31 to the outside. As materials of the conductor 31, copper, a material (for example, aluminum) having a higher rigidity than the copper, and a material (for example, aluminum) having a lower conductivity than the copper are used. In the embodiment 1, the conductor 31 made of aluminum or an aluminum alloy is used.

A front part of the electric wire crimping section 12 is formed as a wire barrel part 13 to which the conductor 31 is connected. A rear part of the electric wire crimping section 12 is formed as an insulation barrel part 14 to which a portion, of the front end of the electric wire 30, where the insulating coating 32 surrounding the conductor 31 is not removed is connected. The wire barrel part 13 has a form in which a pair of symmetrical barrel pieces 16 is extended from left and right side edges of a bottom plate portion 15. The electric wire 30 crimped to the wire barrel part 13 is pressurized with the electric wire 30 being entirely surrounded with the bottom plate portion 15 and a pair of the barrel pieces 16 and electrically conductively fixed to the wire barrel part 13 by a fixing force generated by the pressurization.

In a crimped state, the projected front end of the conductor 31 is positioned forward from the front edge of the barrel pieces 16. In the longitudinal direction of a wire barrel (barrel piece 16), the range of a clamping region 17 to be clamped by a crimper of an applicator (not shown in the drawings) is limited to a range except the front and rear ends of the barrel piece 16. The front and rear edges of the clamping region 17 are formed as an oblique (tapered) bellmouth 18 such that the front and rear edges of the clamping region 17 are slightly diametrically larger than the clamping region 17. Because the bellmouth 18 is formed by limiting the range of the clamping region 17 to the above-described range, the front and rear edges of the inner periphery of the barrel piece 16 do not cut the thin metal wires composing the conductor 31.

A fixing portion 20 and a locking portion 21 are formed on the wire barrel part 13. The fixing portion 20 has a wall-like form formed by displacing a portion, of the wire barrel part 13, which is disposed within the range of the clamping region 17 in the longitudinal direction of the wire barrel part 13 to the conductor 31 (to inner peripheral surface) and has a flat end surface along the direction in which the conductor 31 is wired. The conductor 31 is disposed along the end surface of the fixing portion 20. In a state of the flat metal plate 10P before it is bent, the fixing portion 20 is parallel with a region (hereinafter referred to as non-fixing portion 22) of the wire barrel part 13 other than the fixing portion 20. A region in which the fixing portion 20 is formed in a left-to-right direction (circumferential direction in crimped state) covers a range from a position inward (side of bottom plate portion 15) from a rising edge of one of the barrel pieces 16 to a position inward (side of bottom plate portion 15) from a rising edge of the other of the barrel pieces 16, including the bottom plate portion 15. The fixing portion 20 is rectangular. A thickness dimension Ta of the fixing portion 20 is uniform in the entire region thereof and equal to a thickness dimension Tb of the non-fixing portion 22.

The locking portion 21 has a form in which front and rear edges of the fixing portion 20 and the non-fixing portion 22 are coupled to each other in a step-like way and left and right edges of the fixing portion 20 and the non-fixing portion 22 are coupled to each other in a step-like way. In other words, the locking portion 21 forms a continuous rectangular frame over the entire periphery of the fixing portion 20. In a direction in which the fixing portion 20 is displaced, namely, inward and outward directions, a thickness dimension Tc of the locking portion 21 is larger than the thickness dimension Ta of the fixing portion 20 and the thickness dimension Tb of the non-fixing portion 22. Although the thickness dimension Tc of the locking portion 21 is smaller than twice the thickness dimension Ta of the fixing portion 20, the thickness dimension Tc thereof may be larger than twice the thickness dimension Ta of the fixing portion 20. An inner surface (surface of locking portion 21 opposed to conductor 31) of the locking portion 21 is continuous with an inner surface (surface of fixing portion 20 which contacts conductor 31) of the fixing portion 20 with an inner surface of the locking portion 21 flush with that of the fixing portion 20. An outer surface of the locking portion 21 is continuous with an outer surface of the non-fixing portion 22 with the outer surface of the locking portion 21 flush with that of the non-fixing portion 22. In the longitudinal direction of the locking portion 21, the locking portion 21 is positioned within the range of the clamping region 17.

In a state in which the conductor 31 is crimped to the wire barrel part 13, the inner surface of the fixing portion 20 and that of the locking portion 21 closely contact the peripheral surface of the conductor 31, whereas a rectangular frame-shaped region, of the inner surface of the non-fixing portion 22, which is disposed in the vicinity of the locking portion 21 does not contact the conductor 31. In the crimped state, an edge-like corner disposed on the inner surface of the locking portion 21 cuts into the periphery of the conductor 31. Owing to the cut-into operation, a large locking area is secured between the conductor 31 and the wire barrel part 13 in a radial direction of the terminal fitting 10. Thereby a fixing force is enhanced between the wire barrel part 13 and the conductor 31 in the longitudinal direction of the terminal fitting 10.

Even though a large clamping force is set in crimping the wire barrel part 13 to the conductor 31, the thick locking portion 21 is difficult to have collapse deformation. Thus there is no decrease in the locking area of the locking portion 21 in relation to the conductor 31. Even though the fixing portion 20 has deformation of curving outward in relation to the locking portion 21 owing to a reaction force applied to the fixing portion 20 from the conductor 31, the thick locking portion 21 little deforms. Therefore there is no fear that the locking area of the conductor 31 in relation to the locking portion 21 decreases. Further because it is unnecessary to form a concave portion which decreases the thickness of the electric wire crimping section 12 on the inner surface thereof, the strength of the entire electric wire crimping section 12 is ensured.

Embodiment 2

Figure 5:
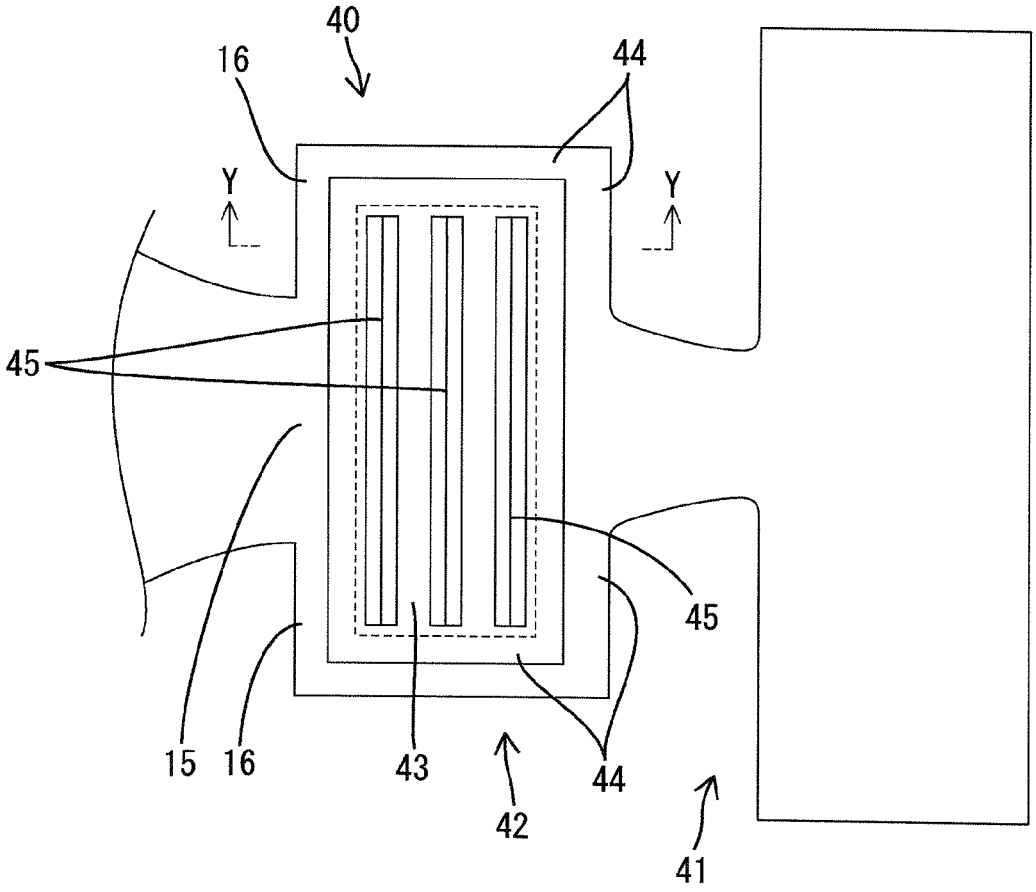
FIG. 5 is a plan view showing the configuration of an electric wire crimping section of a metal plate in an embodiment 2.
Figure 6:
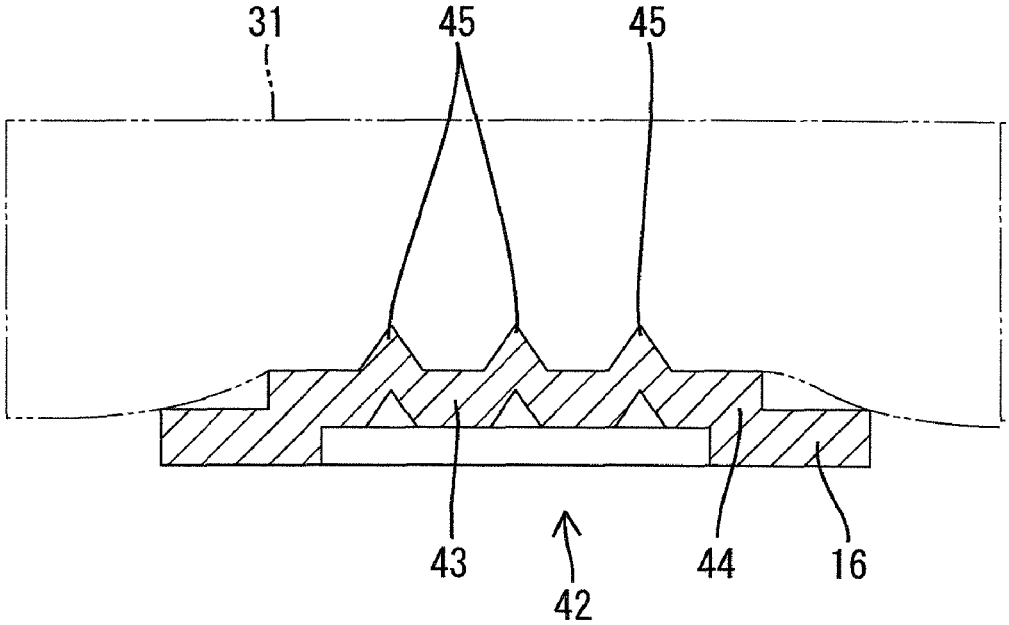
FIG. 6 is a sectional view taken along a line Y-Y of FIG. 5.

The embodiment 2 of the present invention is described below with reference to FIGS. 5 and 6. The construction of a fixing portion 43 formed on a wire barrel part 42 of an electric wire crimping section 41 of a terminal fitting 40 of the embodiment 2 is different from the fixing portion 20 of the terminal fitting 10 of the embodiment 1. Because other constructions of the embodiment 2 are the same as those of the embodiment 1, the same parts of the embodiment 2 as those of the embodiment 1 are denoted by the same reference numerals as those of the embodiment 1, and the description of the constructions, operation, and effect of the embodiment 2 is omitted herein.

A fixing portion 43 and a locking portion 44 both similar to those of the embodiment 1 are formed on the wire barrel part 42 of the embodiment 2. A cut-into portion 45 projected to the conductor 31 is formed on an end surface of the fixing portion 43. The cut-into portion 45 is formed by press work of striking the fixing portion 43 from its outer surface. The cut-into portion 45 extends in a circumferential direction (direction parallel with rising direction of barrel piece 16 from bottom plate portion 15) intersecting with the axis of the conductor 31. A plurality of the cut-into portions 45 is arranged in parallel at certain intervals in the longitudinal direction of the terminal fitting 40. Each of the cut-into portions 45 is approximately triangular in section. In a state in which the conductor 31 of the electric wire 30 is crimped to the wire barrel part 42, the cut-into portion 45 cuts into the periphery of the conductor 31. Thereby the fixing portion provides a high fixing performance.

In the embodiments 1 and 2, aspects described below are included in the technical scope of the present invention.

(1) In the embodiments 1 and 2, the region in which the fixing portion is formed is disposed within the range inward from the outer edge of the electric wire crimping section. But according to the present invention, the region in which the fixing portion is formed may reach the outer edge of the electric wire crimping section.

(2) In the embodiments 1 and 2, one fixing portion is formed on the electric wire crimping section. But according to the present invention, a plurality of the fixing portions may be formed on the electric wire crimping section.

(3) In the embodiments 1 and 2, description has been made on an example in which the terminal fitting is used as a female terminal fitting. But the terminal fitting of the present invention can be also used as a male terminal fitting.

Embodiment 3

Figure 7:
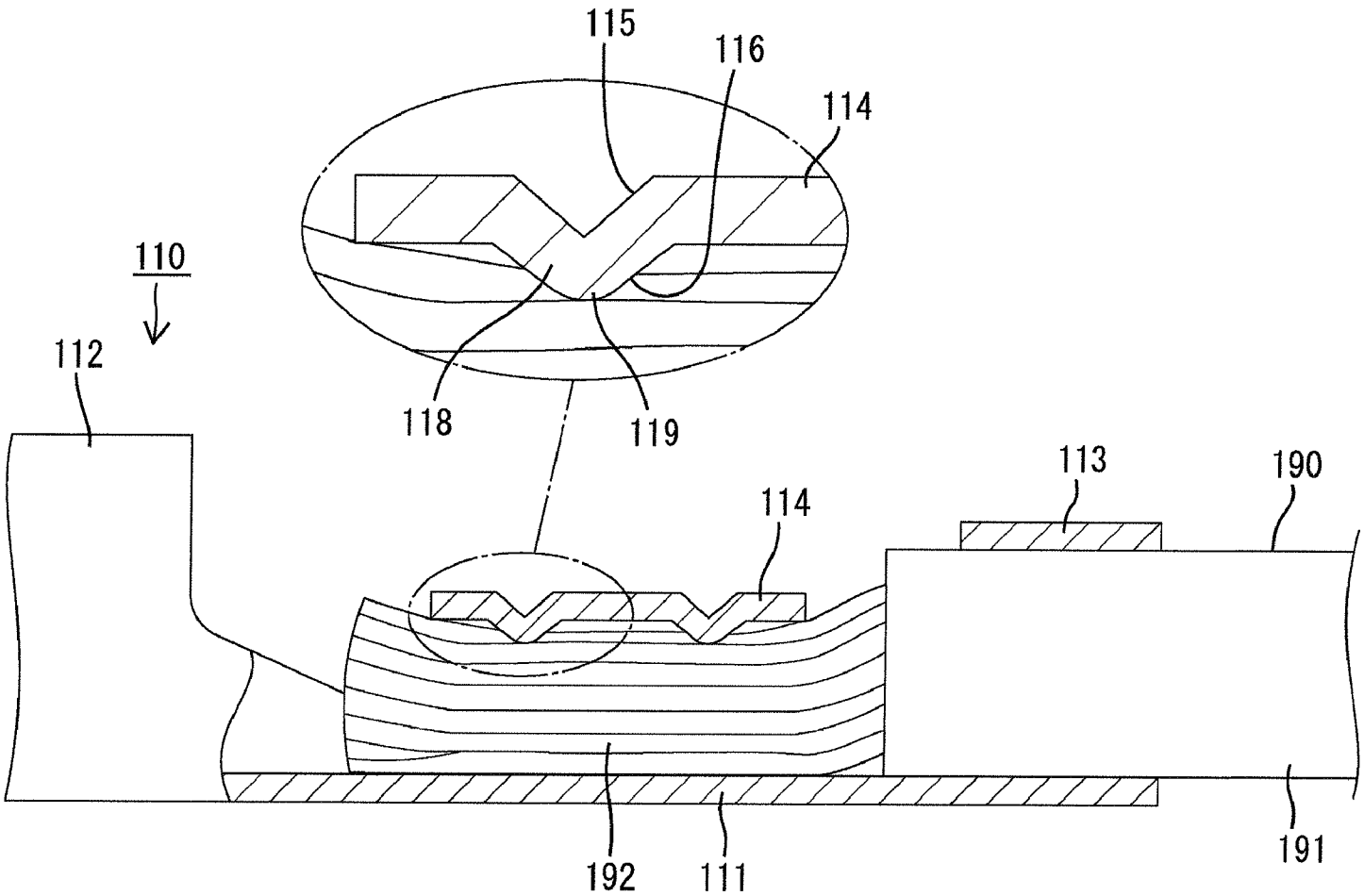
FIG. 7 is main parts-broken away side view showing a terminal fitting of an embodiment 3.
Figure 8:
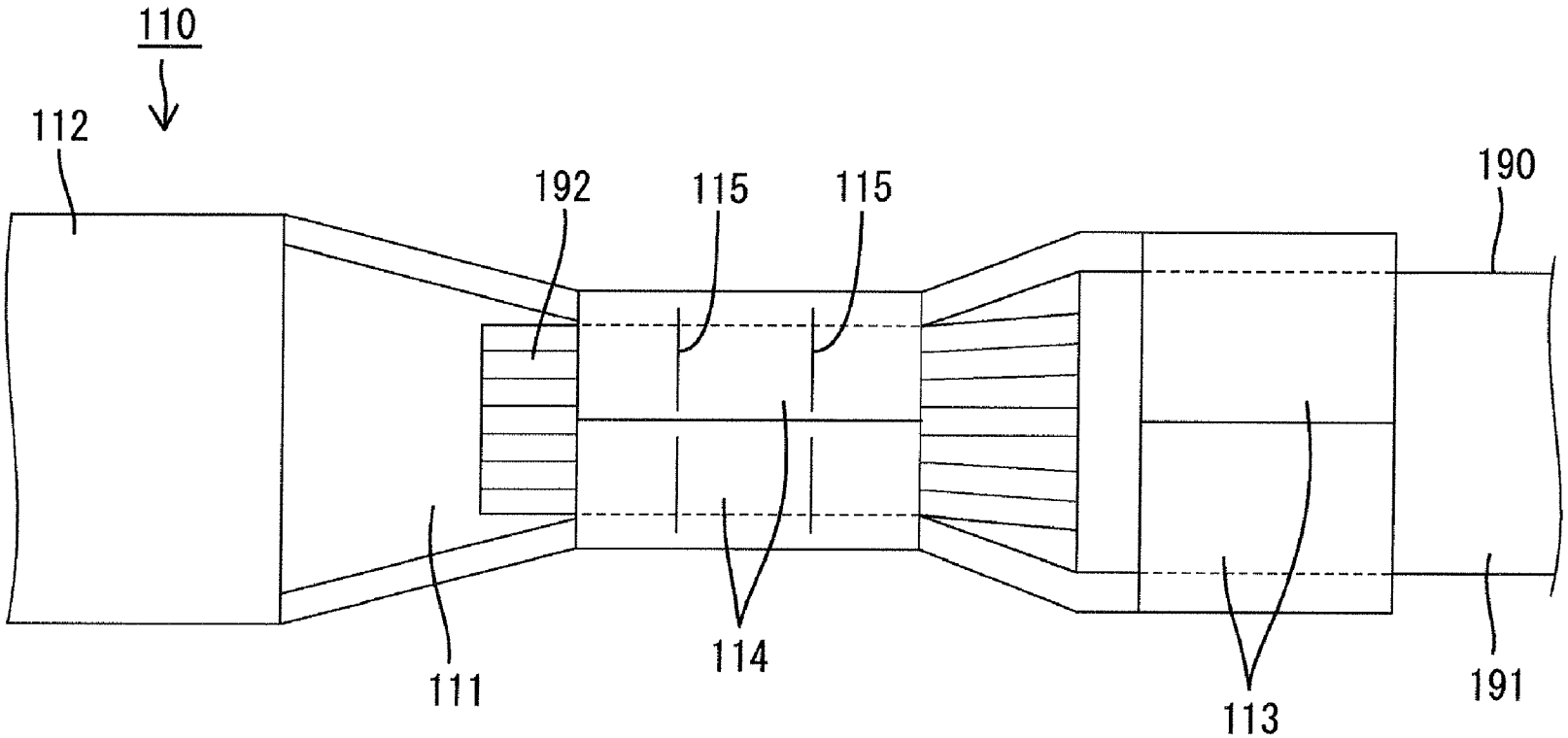
FIG. 8 is a main parts-depicted plan view showing the terminal fitting.

The embodiment 3 of the present invention is described below with reference to FIGS. 7 and 8. A terminal fitting 110 of the embodiment 3 is connected to the end of an electric wire 190 and accommodated inside a connector housing not shown in the drawings. In that state, the terminal fitting 110 is fitted on a mating connector not shown in the drawings. Thereby the terminal fitting 110 is conductively connected with a mating terminal fitting not shown in the drawings. The terminal fitting 110 is integrally formed by punching a conductive metal plate consisting of copper or a copper alloy into a predetermined configuration and thereafter bending it and has a band plate-shaped substrate part 111 extended longitudinally over the entire length of the terminal fitting 110.

A connection part 112, bent in the shape of a prism, which receives the mating terminal fitting and is electrically connected thereto is provided at a front end of the substrate part 111. A pair of outwardly projected open barrel-shaped holding pieces 113 which is to be crimped to a coating 191 disposed at the end of the electric wire 190 from the outside is provided at both side edges (both edges in widthwise direction orthogonal to extended direction) of a rear end of the substrate part 111. After both holding pieces 113 are crimped to the coating 191, both holding pieces 113 are turned along the peripheral surface of the coating 191 of the electric wire 190 and thereafter the front ends thereof are butted to each other at approximately the central portion of the substrate part 111 in the widthwise direction thereof, as shown in FIG. 8. Between the connection part 112 and both holding pieces 113 in the longitudinal direction of the terminal fitting 110, there is provided at both side edges of the substrate part 111 a pair of outwardly projected open barrel-shaped barrel pieces 114 which is to be crimped from the outside to a conductor 192 consisting of a core exposed to the outside at the end of the electric wire 190. Both barrel pieces 114 are crimped to the conductor 192 of the electric wire 190 in such a way that the barrel pieces 114 cut deep into approximately the central portion of the conductor 192 in the widthwise direction thereof. After the barrel pieces 114 are crimped to the conductor 192, the front ends of the barrel pieces 114 are butted to each other at approximately the central portion of the substrate part 111 in the widthwise direction thereof. The electric wire crimping section of the present invention is constructed of the substrate part 111 and the barrel pieces 114.

The electric wire 190 is wired in the lengthwise direction (longitudinal direction) of the substrate part 111 and constructed of the conductor 192 formed by twisting wires consisting of aluminum or an aluminum alloy together and the coating 191, made of an insulating resin, which covers the conductor 192.

A fixing portion 119 is formed on both barrel pieces 114 by displacing a part of both barrel pieces 114 to the conductor 192. As shown in FIG. 7, a pair of the fixing portions 119 is disposed on the barrel pieces 114 at the middle thereof in the longitudinal direction thereof by longitudinally spacing the fixing portions 119 at a certain interval and extends linearly widthwise. A concave portion 115 concave to an inner surface of each barrel piece 114 is formed at a position, of an outer surface thereof, corresponding to the position of each fixing portion 119. Each concave portion 115 is a striate extending widthwise and V-shaped in section. As shown in FIG. 8, the concave portions 115 are straight and disposed in parallel with each other with each concave portion 115 stretching over both barrel pieces 114. A convex portion 116 projected to the conductor 192 is formed at a position, of the inner surface of each of the barrel pieces 114, corresponding to the position of each fixing portion 119 with the convex portion 116 and the concave portion 115 disposed back to back. Each convex portion 116 extends linearly widthwise and V-shaped in section. The convex portions 116 are straight in parallel with each other with each convex portion 116 stretching over both barrel pieces 114. Briefly the convex portion 116 has a configuration matching that of the concave portion 115. Therefore including portions corresponding to the convex portion 116 and the concave portion 115, each of the barrel pieces 114 has almost the same thickness over the entirety thereof. The convex portion 116 and the concave portion 115 are formed on only both barrel pieces 114 and not formed on the connection part 112, the substrate part 111, and both holding pieces 113. The fixing portion 119 and portions of each of the barrel pieces 114 disposed forward and rearward therefrom are coupled to each other with a locking portion 118 in a step-like way.

The method of producing the terminal fitting 110 of the embodiment 3 and the operation and effect thereof are described below.

After the coating 191 disposed at the end of the electric wire 190 is peeled to expose the conductor 192 to the outside, the electric wire 190 is placed on the upper surface of the substrate part 111. Thereafter both barrel pieces 114 and both holding pieces 113 are crimped to the conductor 192 and the coating 191 respectively by using unshown jigs such as an anvil and a crimper. As a result, both barrel pieces 114 incline inward, and the front ends thereof cut into the central portion of the conductor 192 in the widthwise direction thereof from the outer side (upper side). Thereby the terminal fitting 110 and the electric wire 190 are electrically connected to each other. Convexities, formed at positions of the inner surface of the jig, corresponding to both barrel pieces 114 press the outer surfaces of both barrel pieces 114 with a movement of the jig. As a result, the concave portion 115 is formed on the outer surfaces of both barrel pieces 114 and the convex portion 116 is formed on the inner surfaces thereof and eventually the fixing portion 119 and the locking portion 118 are formed. Thereafter the convex portion 116 of the locking portion 118 cuts into the surface of the conductor 192 like an edge. Thereby the conductor 192 is tightly crimped to the barrel pieces 114. In this case, even though an oxide film consisting of aluminum oxide is formed on the surface of the conductor 192, the convex portion 116 destroys the oxide film mechanically as soon as the convex portion 116 is formed by molding. Thus good connection reliability between both barrel pieces 114 and the conductor 192 is securely obtained.

In the above-described case, because a force is applied to both barrel pieces 114 in the thickness direction thereof owing to the caulking operation, both barrel pieces 114 are spread, there is a possibility that the strength of a portion, of each of the barrel pieces 114, corresponding to the concave portion 115 decreases. But according to the embodiment 3, the concave portion 115 and the convex portion 116 are formed on both barrel pieces 114 at back to back positions. Thus compared with a case in which only the concave portion 115 which decreases the sheet thickness of both barrel pieces 114 is formed thereon, the sheet thickness of both barrel pieces 114 does not greatly decrease, and in addition the convex portion 116 keeps an elongation amount of both barrel pieces 114 low. Consequently the strength of both barrel pieces 114 is properly secured.

Because the convex portions 116 and the concave portions 115 are formed on only both barrel pieces 114, i.e., the convex portions 116 and the concave portions 115 are formed efficiently at portions which apply a high crimping force to the conductor 192. Therefore it is possible to avoid the terminal fitting 110 from having a complicated construction more than necessary.

Further because the convex portion 116 and the concave portion 115 are formed in the shape of the striate extending in the direction intersecting with the direction in which the conductor 192 is wired, the conductor-retaining force of the barrel piece is further enhanced.

Further because the convex portion 116 and the concave portion 115 are formed as soon as the crimping operation is performed, both barrel pieces 114 crimped to the conductor 192 is effectively prevented from undergoing deformation of opening outward owing to spring back.

Embodiment 4

Figure 9:
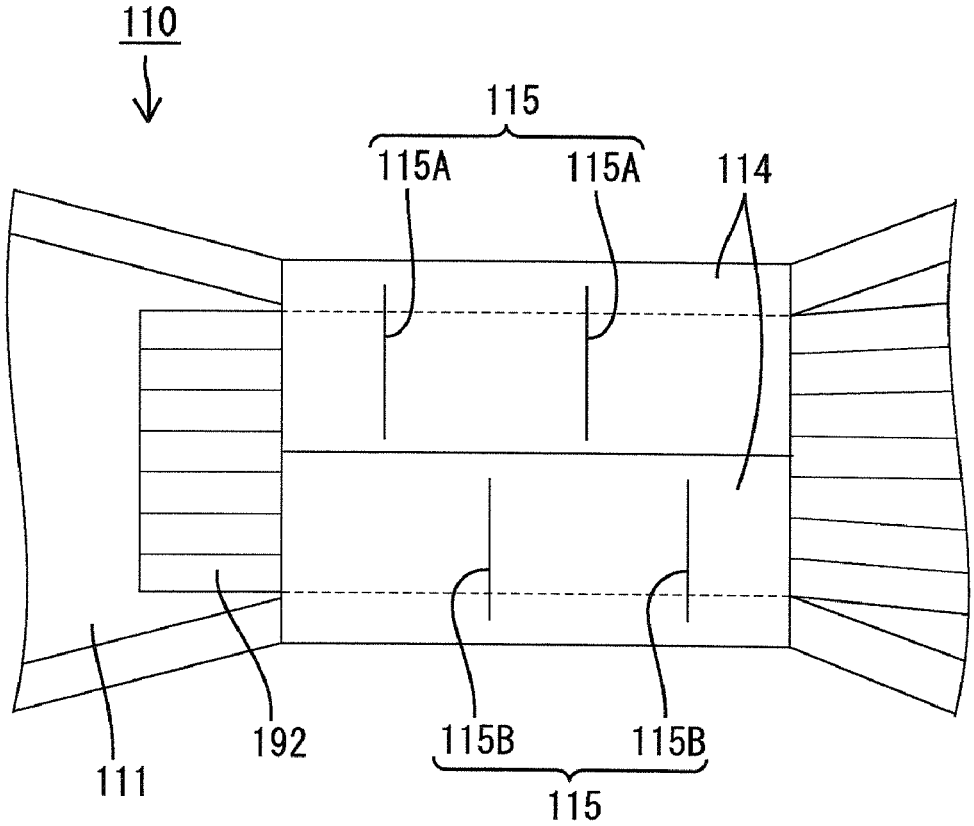
FIG. 9 is a main parts-depicted plan view showing a terminal fitting of an embodiment 4.

FIG. 9 shows the terminal fitting 110 of the embodiment 4. The disposition of the fixing portion 119 and that of the locking portion 118, namely, the disposition of the convex portion 116 and that of the concave portion 115 are different from those of the embodiment 3. That is, the concave portion 115 has first concave portions 115A arranged in parallel with each other on one of the outer surfaces of both barrel pieces 114 and second concave portions 115B arranged in parallel with each other on the other of the outer surfaces of both barrel pieces 114. The first concave portions 115A and the second concave portions 115B are extended linearly in the widthwise direction of both barrel pieces 114 and disposed in a zigzag pattern such that the first concave portions 115A and the second concave portions 115B are alternately formed on the outer surfaces of both barrel pieces 114 in the longitudinal direction thereof. The unshown convex portion 116 has also first convex portions and second convex portions at positions back to back in relation to the positions of the first concave portions 115A and the second concave portions 115B.

In the embodiments 3 and 4, aspects described below are included in the technical scope of the present invention.

(1) The convex portion and the concave portion may be formed on the inner and outer surfaces of both barrel pieces by striking the outer surfaces of both barrel pieces after both barrel pieces are crimped to the conductor.

(2) The configuration of the convex portion and that of the concave portion are arbitrarily selected. For example, they may be rectangular U-shaped in section.

(3) The number of the convex portions and that of the concave portions are arbitrarily selected and may be singular or not less than three.

(4) The terminal fitting may be a male terminal fitting having a male tab projected forward.

(5) The electric wire may be a copper electric wire having a conductor formed by twisting a plurality of wires consisting of copper or a copper alloy together.

The invention claimed is:

1. A terminal fitting comprising:

an open-barrel shaped electric wire crimping section for connecting a conductor of an electric wire to said terminal fitting by crimping, the electric wire crimping section having a clamping region in a range except for both ends of the electric wire crimping section in a wiring direction of the conductor;

a fixing portion formed by displacing a part of the clamping region of said electric wire crimping section to said conductor; and a plurality of locking portions disposed at both sides of the fixing portion in the wiring direction of the conductor with the fixing portion being located therebetween respectively and having a form of coupling said fixing portion and a remainder of said electric wire crimping section to each other in a step-like way.

2. A terminal fitting according to claim 1, wherein each of said locking portions has a thickness in a direction in which said electric wire crimping section is displaced to said conductor, the thickness being set larger than that of said fixing portion.

3. A terminal fitting according to claim 2, wherein said fixing portion has an end surface disposed nearly along the wiring direction of said conductor.

4. A terminal fitting according to claim 3, wherein a cut-into portion projected to said conductor like a rib is formed on said end surface of said fixing portion.

5. A terminal fitting according to claim 1, wherein said electric wire crimping section has a substrate part on which said conductor is plated; and a pair of barrel pieces, projected from both sides of said substrate part, which are crimped to said conductor from an outside;

said fixing portion is formed on said barrel pieces;

a concave portion concave to an inner surface of each of said barrel pieces is formed at a portion, of an outer surface of each of said barrel pieces thereof, which corresponds to said fixing portion; and a convex portion projected to said conductor is formed at a position, of an inner surface of each of said barrel pieces, which corresponds to said fixing portion with said convex portion and said concave portion being disposed back to back.

6. A terminal fitting according to claim 5, wherein said convex portion and said concave portion are formed on only said barrel pieces.

7. A terminal fitting according to claim 5, wherein said convex portion and said concave portion are formed in a shape of a striate extending in a direction intersecting with a direction in which said conductor is wired.

8. A terminal fitting according to claim 1, wherein said fixing portion has an end surface disposed nearly along the wiring direction of said conductor.

9. A terminal fitting according to claim 8, wherein a cut-into portion projected to said conductor like a rib is formed on said end surface of said fixing portion.

10. A terminal fitting according to claim 5, wherein said convex portion and said concave portion are formed in a shape of a striate extending in a direction intersecting with a direction in which said conductor is wired.

11. A terminal fitting for connection to a wire, the wire having an end, a conductor extending longitudinally from the end and an insulating coating surrounding at least parts of the conductor, the insulating coating being removed adjacent the end for exposing the conductor, the terminal fitting having opposite front and rear ends spaced apart along a longitudinal direction and comprising:

a terminal fitting connection section adjacent the front end and configured for connection to a mating terminal fitting;

an insulation barrel part adjacent the rear end and crimped into connection with the insulating coating of the wire; and a wire barrel part having opposite front and rear ends and being disposed between the terminal fitting connection section and the insulation barrel part, the wire barrel part including a fixing portion between the front and rear ends of the wire barrel part and crimped inward into connection with the conductor of the wire, front and rear locking portions projecting out at opposite longitudinal ends of the fixing portion to define inwardly directed corners cutting into a periphery of the conductor of the wire.

12. The terminal fitting of claim 11, further comprising at least one non-fixing portion at an outer end of at least one of the front and rear locking portions and extending in a direction away from the fixing portion.

13. The terminal fitting of claim 11, wherein a thicknesses of the front and rear locking portions measured normal to the longitudinal direction exceeds a thickness of the fixing portion measured normal to the longitudinal direction.

14. The terminal fitting of claim 13, wherein part of the inwardly directed corner of the front locking portion faces forward and part of the inwardly directed corner of the rear locking portion faces rearward.

* * * * *